US006733059B2

(12) United States Patent
Flathau

(10) Patent No.: US 6,733,059 B2
(45) Date of Patent: May 11, 2004

(54) OUTSIDE CONVERSION CORNER FOR FORM WORK

(75) Inventor: Robert J. Flathau, Antioch, IL (US)

(73) Assignee: Safway Formwork Systems, LLC, Waukesha, WI (US)

( * ) Notice: Subject to any disclaimer, the term of this patent is extended or adjusted under 35 U.S.C. 154(b) by 0 days.

(21) Appl. No.: 10/120,761

(22) Filed: Apr. 11, 2002

(65) Prior Publication Data

US 2002/0145100 A1 Oct. 10, 2002

Related U.S. Application Data

(62) Division of application No. 09/721,077, filed on Jan. 22, 2000, now Pat. No. 6,419,204.
(60) Provisional application No. 60/166,959, filed on Jan. 23, 1999.

(51) Int. Cl.[7] ..... E04G 13/02; E04G 17/00
(52) U.S. Cl. ..... 294/194; 294/47; 294/48; 52/731.4; 52/737.6
(58) Field of Search ..... 52/742.14, 731.8, 52/731.2, 731.4, 731.5, 731.7, 732.1, 737.6, 279, 282.1; 249/193, 194, 47, 48, 49

(56) References Cited

U.S. PATENT DOCUMENTS

| | | | | | |
|---|---|---|---|---|---|
| 147,011 | A | * | 2/1874 | Kellogg | 52/731.8 |
| 340,070 | A | | 4/1886 | Carrico | |
| 481,243 | A | | 8/1892 | Orr | |
| 854,654 | A | * | 5/1907 | Krantz | 52/282.1 |
| 901,209 | A | | 10/1908 | Sullivan | |
| 1,109,810 | A | | 9/1914 | Wilson | |
| 1,129,658 | A | * | 2/1915 | Foy | 249/188 |
| 1,170,753 | A | | 2/1916 | Hodges | |
| 1,171,760 | A | | 2/1916 | Venable | |
| 1,235,542 | A | | 8/1917 | Bagby | |

(List continued on next page.)

FOREIGN PATENT DOCUMENTS

| | | |
|---|---|---|
| AU | 214413 | 8/1956 |
| DE | 852147 | 7/1949 |
| DE | 2919468 | 11/1980 |
| FR | 1017047 | 11/1952 |
| GB | 2056538 | 3/1981 |
| JP | 2-285148 | 11/1990 |
| JP | 3-260264 | 11/1991 |

OTHER PUBLICATIONS

Brochure—Plettac *Profil*, No. 10, pp. 1–8 Dec. 1998.
Brochure—Safway *The Platform*, Dec. 1998, pp. 1–12.
Brochure—*Rasto Formwork*, Assembly Instructions, Nov. 1996, pp. 1–24.

*Primary Examiner*—Brian E. Glessner
(74) *Attorney, Agent, or Firm*—Whyte Hirschboeck Dudek SC

(57) ABSTRACT

A building member forming apparatus is comprised of standardized metric dimensioned panels including plywood paneling, outer horizontal support beams, vertical support beams, and inner horizontal support beams. A conversion corner bracket has a first leg and a second leg joined to form a right angle, a V-shaped indented outer corner, and a rounded inside corner opposite the V-shaped indented corner. The conversion corner bracket is attached to the panels by securing members which secure the conversion corner bracket to the vertical support beam of the panels. The conversion corner allows the apparatus to convert standardized dimensioned panels for use with either metric or U.S. customary unit-based construction structures.

1 Claim, 7 Drawing Sheets

U.S. PATENT DOCUMENTS 1,240,436 A * 9/1917 Gendron et al. ..... 249/38
1,374,864 A 4/1921 Rashkovsky
1,468,702 A 9/1923 Dunn
1,536,651 A * 5/1925 Bowen ..... 52/731.7
1,552,334 A 9/1925 Mosher
1,670,338 A 5/1928 Butterworth
1,861,766 A 6/1932 Venard
1,871,919 A 8/1932 Schubert
1,977,715 A * 10/1934 Coleman ..... 52/731.7
2,017,553 A 10/1935 Troiel
2,475,890 A 7/1949 Hamilton
3,260,493 A 7/1966 Beckham
3,420,021 A * 1/1969 Anghinetti et al. ..... 52/264
3,672,626 A 6/1972 Thornton
3,917,216 A 11/1975 Plough
4,433,826 A 2/1984 Schimmel
4,717,517 A 1/1988 Halberstadt
4,893,445 A * 1/1990 Hefer et al. ..... 52/234
4,944,664 A 7/1990 Allred
4,949,648 A * 8/1990 Miller ..... 108/107
4,958,800 A 9/1990 Carlson
4,978,099 A 12/1990 Carlson
5,044,601 A 9/1991 Miller
5,397,095 A 3/1995 Jeffrey
5,616,271 A 4/1997 Podgurski
5,700,106 A 12/1997 Young et al.
6,454,111 B1 * 9/2002 Berryhill ..... 217/13

* cited by examiner

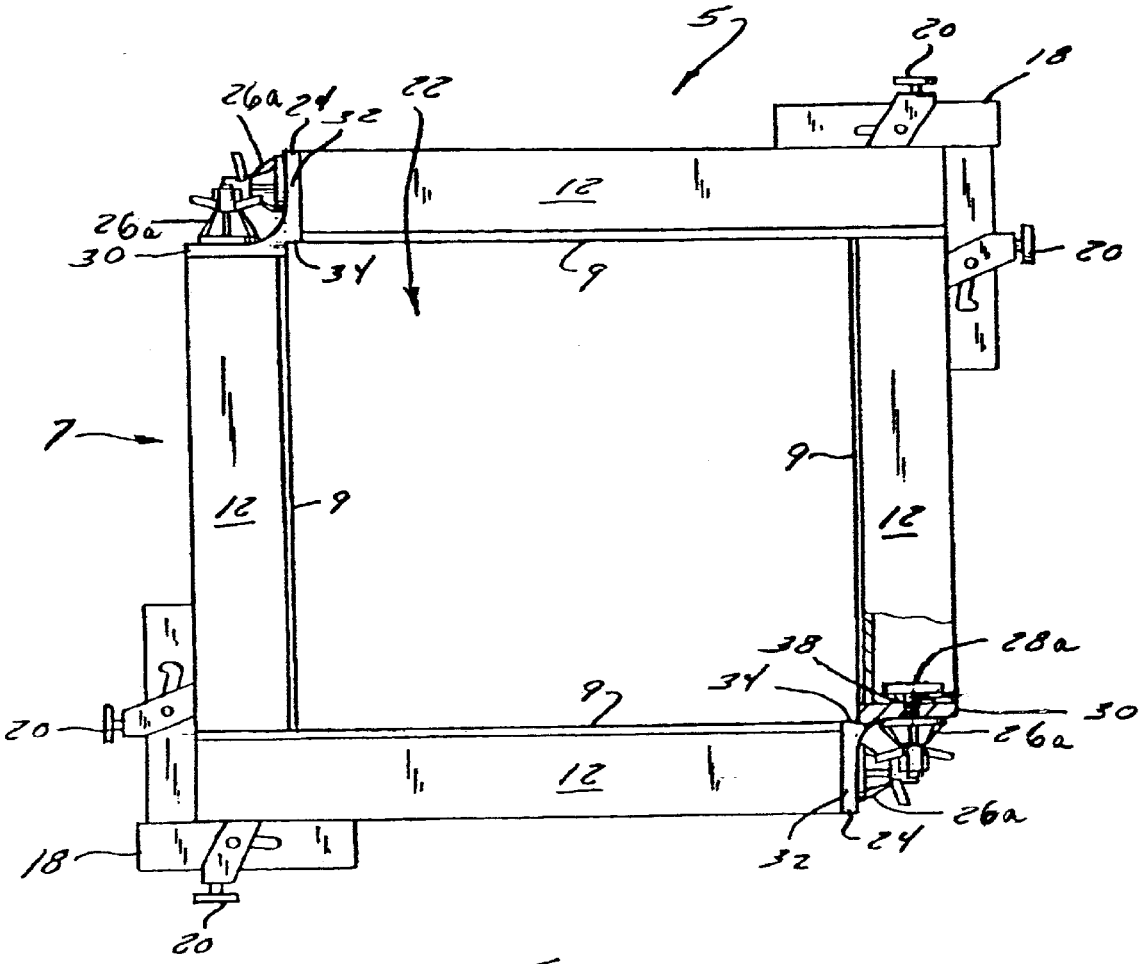
FIG. 2A
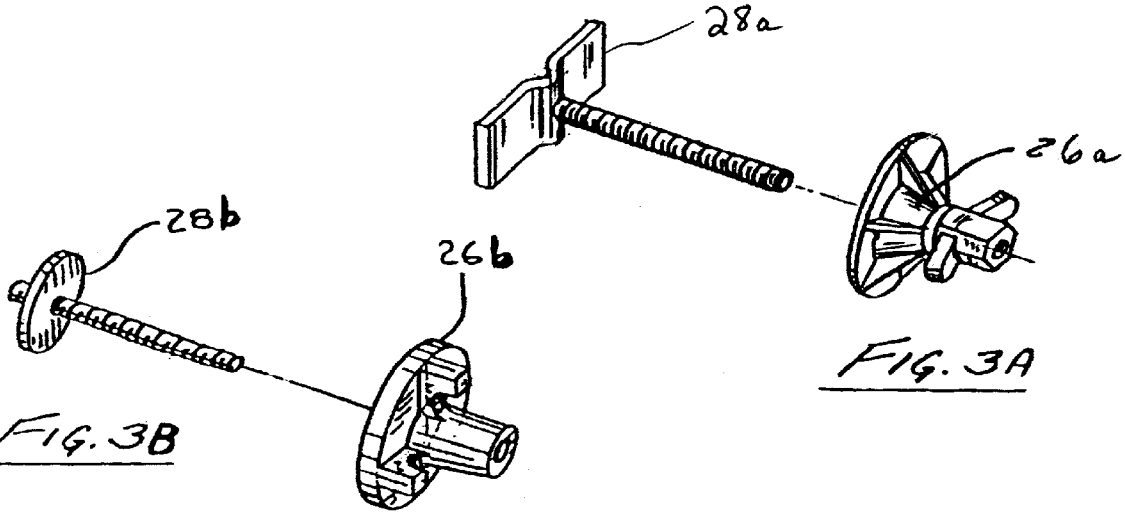
FIG. 3A
FIG. 3B

OUTSIDE CONVERSION CORNER FOR FORM WORK

CROSS-REFERENCE TO RELATED APPLICATIONS

This application is a division of U.S. Pat. application Ser. No. 09/721,077, filed Nov. 22, 2000, now U.S. Pat. No. 6,419,204; which claims priority benefit of U.S. Provisional Application Serial No. 60/166,959, filed Nov. 23, 1999, expired.

BACKGROUND OF THE INVENTION

1. Field of the Invention

The present invention relates in general to the field of building construction. More particularly, the present invention relates to building construction form work structures. Specifically, a preferred embodiment of the present invention relates to outside conversion corner piece for joining form work panels.

2. Discussion of the Related Art

Historically, builders have used form work panels to form walls and columns. For example when forming a wall, concrete is poured between two opposing panels of form work and over vertically projecting re-bar. After the concrete cures, the panels are removed to leave a free-standing wall. Similarly, when forming a column concrete is poured over inside pairs of opposing panels of form work and vertically projecting re-bar. When the concrete cures, the panels are removed to leave a free-standing column.

Some form work panels are imported from abroad. These panels are often made according to the exporting country's measurement system. For example, it is nearly impossible to use panels imported from Europe on construction projects in the U.S. or other home country. This is because imported panels are typically created to conform with metric units. Metric units do not translate well in the world of U.S. building construction because contractors are typically not as familiar with such measurements and equipment. Moreover, building codes and blueprint specifications are not easily tailored to metric units to meet the builders' needs.

As is known to those skilled in the art, wood slats or other "fillers" must often be used to extend the dimensions of the panels so that they can be used in U.S. construction projects. Others offset or cut the panels to meet their needs for forming walls. After crude modifications such as these are made, these panels can often meet most desired U.S. customary unit-based system measurement specifications.

However, the metric-sized panels are especially problematic when used to form columns on U.S. construction projects. One unsatisfactory previously recognized approach to solving the problem referred to herein involves the use of wood slats or fillers mentioned above. Fillers are generally impractical as they take time to construct and put into place. With the high cost of construction crew labor, this previously recognized solution also has the disadvantage of relatively high cost. Consequently, a preferred solution will be seen by the end-user as being cost effective. A solution is cost effective when it is seen by the end-user as compelling when compared with other potential uses that the end-user could make of limited resources.

Also, the fillers may shift during the concrete pouring or drying process. This may cause safety and/or structural problems. Because of this fact, a number of jurisdictions restrict the use of the aforementioned previously recognized approach because of the aforementioned disadvantages.

However, since up until now there has been no suitable alternative, many jurisdictions are generally not enforcing such a prohibition.

What is needed therefore is a device which converts odd-sized imported form work building panels for use in the home country. Further, what is also needed is an inventive outside conversion corner configured and dimensioned such that the panels can be easily joined to fit most U.S. customary unit applications.

The below-referenced U.S. patents, and allowed U.S. applications in which the issue fees have been paid, disclose embodiments that were at least in-part satisfactory for the purposes for which they were intended. The disclosures of all the below-referenced prior United States patents, and applications, in their entireties are hereby expressly incorporated by reference into the present application for purposes including, but not limited to, indicating the background of the present invention and illustrating the state of the art.

U.S. Pat. No. 5,700,106 relates to an easily assembled concrete form including a plurality of elongated wall members manufactured by roll forming and connected together to define an enclosure. Each wall member has a first end and a second end, an inner surface and an outer surface. Attached to the inner surface of the wall member at the first end is a U-shaped key having legs extending beyond the first end of the wall member. Attached to the inner surface of the wall member at the second end is an interlocking bracket having two vertically spaced slots for receiving the legs of the U-shaped key to connect adjacent wall members together. One of the slots is enlarged for also receiving an extending flange from a support bracket to frictionally maintain the U-shaped key and interlocking bracket in a locked relationship.

U.S. Pat. No. 5,397,095 relates to a modular building system for constructing the frame of a structure. Standardized foundation forms, vertical forms, and tie beam forms are attached to each other. The vertical forms are hinged so as to be capable of defining a corner of any angle. Cover plates are selectively inserted into the tie beam forms so as to define a reception recess which corresponds to the size of a roof truss being used. The various forms can be attached to each other with a minimal amount of labor.

U.S. Pat. No. 5,044,601 relates to an outside bay adaptor for a concrete forming structure. The adaptor has a pair of elongated flat plates, each of substantial length. The plates are disposed in an angular V-shaped relation to one another. The plates have a pair of confronting slots. The slots on the plates are transversely aligned with one another. Slotted wedge bolts are extended through the line slots and extend outwardly and in diverging relation to one another and adjacent opposite ends of the plates. A weldment is located at each end of the plates. The weldment connects the slotted wedge bolts which extend through the slots to the plates in a unitary assembly.

U.S. Pat. No. 4,958,800 discloses a locking hinge mechanism for concrete forms. The mechanism includes parallel hinge strips connected together by hinges positioned at intervals along the length of the strips. Each hinge includes a provision for a wedge lock. The wedge lock when fully inserted position the hinge strips at a secure 90° angle. The hinge strips are spaced apart from the juncture of the strips, when arranged at the 90° angle, so that concrete flashings do not clog the hinge. The hinge strips are in turn affixed to side rails of the joining concrete forms to form a 90° angle, such as for a column form arrangement.

U.S. Pat. No. 3,917,216 discloses a quick release fastening device for releasably securing together the outer edges of two pivotally connected right angle sections of a concrete column form. The concrete form is comprised of a series of upstanding rectangular panels, some of which are in a contiguous relationship. Along their adjacent side edges are outwardly extending flange-like members which extend at right angles to each other and have transverse slots therein. The quick release fastening device consists of a T-bolt embodying a plate-like body portion at one end and a reduced longitudinally slotted shank at the other end. The body portion is disposed in the space between the two flange-like members and abuts against one of the flange-like members. The shank portion extends through and beyond a transverse slot in one flange-like member. An additional T-bolt may also be employed.

U.S. Pat. No. 901,209 discloses an improved clip which is composed of sheet metal and made in one piece. It comprises a body portion 1 having two sets or pairs of spaced engaging portions or flanges, 2 and 3, arranged respectively in planes at right angels to each other. A supplemental flange 6 having an opening 7 is formed on the body 1 at a point centrally between the flanges 3, a flange 4. Formed in the body 1 at points near its ends are openings or perforations 8 for reception of screws or other fastening members by means of which the clip may be attached to one of the mold sections or boards.

U.S. Pat. No. 1,109,810 discloses cross bars which are attached to the sides of the molding boards. The opposite members of each pair are drawn together to clamp the molding boards between them, by longitudinal strips, preferably, though not necessarily, in the form of angle irons 4 which extend lengthwise the column and overlie and the ends of the cross bars. Bolts 5 are then employed to clamp the irons together at any appropriate points, preferably, however, near the top and bottom of the mold and at one or more intermediate points according to the dimensions of the mold. The angle irons may be drilled at frequent intervals as represented so that the bolts may be inserted at any point required.

U.S. Pat. No. 1,170,753 discloses a form for concrete columns. The form consists of a series of angle plates having a series of apertures formed in their edges and adapted to be adjustably secured together by bolts located in apertures of adjacent plates. A series of longitudinally extending notched braces are located at intermediate points of the sides of the mold, and a series of transversely extending clamps are located in the notches of the longitudinally extending braces. These embrace the joined plates and have a series of apertures formed therein.

U.S. Pat. No. 1,171,760 discloses the vertical end edges of the panels 2 and 5 along with angles 23 and 24. These angles are similar to the angles 18 and 19 illustrated in FIG. 1. Bolted to the flanges of these angels are the angles 25 and 26, the free wings of which, as indicated FIG. 3, are provided with a plurality of horizontal slots 27. Angle 25 has slots 27 at left hand end of panel 2 in FIG. 1. The corner panel 7 is provided with a plurality of rows of holes 28 (FIG. 1). This panel is secured to the angles 25 and 26 by means of stove bolts 29 which extend through the holes in the corner panel and through the slots 27 in the wings of the angles 25 and 26. This arrangement gives any and all desired adjustments since the slots 27 in the arms or flanges of the angles 25 and 26 lying next the plates 7 give adjustments lying between the holes in the rows 28.

U.S. Pat. No. 1,374,864 discloses a form which is designed for use in molding a concrete column of rectangular shape in cross section each of the sections will comprise four parts 1, 2, 3 and 4 of such proportions that when they are arranged in the manner shown in FIG. 2 they will overlap each other more or less according to the diameter of the column, each of said parts being of substantially L-shaped in outline. The parts of the base section A are of substantially channel shaped in vertical cross section, as shown in FIG. 4, and each of the parts comprises a vertical web 5 provided at its upper and lower edges with an outwardly-projecting portion or vertical flange 7*a*. The parts are adapted to be arranged in telescopic engagement with each other by slipping one end of each part longitudinally into the end of an adjacent part, thus forming a rectangular shaped frame composed of four parts that are interlocked securely with each other.

U.S. Pat. No. 1,468,702 discloses a structure preferably comprised of two elongated rectangular shaped walls A and B. These walls are permanently and integrally joined to each other along their meeting longitudinal edges so as to be disposed in planes at right angels to each other in transverse section. Adjacent the longitudinal edges, opposite the joined edges, walls A and B are, respectively, provided with parallel pairs of ears 5 and 6. The movable walls C and D are hingedly connected to walls A and B by upper and lower hinge brackets 7 and 8. The brackets extend from the respective walls, i.e., brackets 7 of wall C are positioned at their lateral ends between ears 6 and pivotally assembled therewith by pins 9. On the other hand, the lateral ends of brackets 8 are similarly positioned between ears 5 and pivotally assembled therewith by pins 10.

U.S. Pat. No. 1,861,766 discloses several wall sections to make up a form such as plates A, B, C, etc. be right-angular in cross-section each having the walls 10 and 11. In FIG. 12, it is shown how these right-angular plates overlie one upon the marginal edge of the other so as to be adjustable to vary the width of the wall of the form which they will serve to make. FIG. 14 shows flanges 12, 13 formed upon the corner parts of each right-angular plate A, B, C and D respectively, the terminals 10A of the walls 10 of which plates project beyond the adjacent extreme end of the flange 12, so these parts are shouldered one against the other. The flanges serve to reinforce the right-angular plates giving them more strength and durability.

FIG. 14 shows how these plates are arranged to provide a rectangular enclosure for building a concrete column or post therein. Since the sheet metal plates will be of inappreciable thickness their overlap will hardly interfere with the flush continuation of each side of the completed column.

In short, a device that converts odd-sized imported form work building panels for use in the home country in a cost-effective manner is of interest to, for example, those in the field of building construction.

SUMMARY AND OBJECTS OF THE INVENTION

By way of summary, the present invention is directed towards a means for using various elements to form a static mold or form work structure. The mold may be used to form a building structure such as a wall corner or a column. The elements include odd-sized molding or form work panels. The means comprises use of a corner bracket for connecting the edges of the panels. The bracket can have a stepped angle bend to form the corner of the mold where the adjacent panels do not abut.

A primary object of the invention is to provide a column or corner forming apparatus which uses a device such as a conversion corner to aid in converting metric sized panels for use in U.S. customary unit-based construction projects. Another object of the invention is to provide a column or corner forming apparatus which uses a device such as a conversion corner to aid in converting U.S. customary unit sized panels for use in metric unit based construction projects. Still another object of the invention is to provide an apparatus that is relatively inexpensive, ruggedized and reliable, thereby decreasing down time and operating costs. Yet another object of the invention is to provide a device that has one or more of the characteristics discussed above but which is relatively simple to manufacture and assemble using a minimum of equipment.

Another object of the invention is to provide a method that can be used to form a concrete member. Another object of the invention is to provide a method that is predictable and reproducible, thereby decreasing variance and operating costs. Another object of the invention is to provide a method that has one or more of the characteristics discussed above but which is relatively simple to setup and operate using relatively low skilled workers.

In accordance with one aspect of the invention, these objects are achieved by providing a method of forming concrete members in standardized U.S. customary unit dimensions from a form work panel structure having standardized metric dimensions, the method comprising the steps of: connecting two form work panels with at least one conversion corner bracket to form a first corner; connecting two additional form work panels with at least one conversion corner bracket to form a second corner; configuring the second corner to oppose the first corner; securing the panels in place; erecting the form work panel structure; and pouring a building material in between the first corner and second corner to form a building member.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIG. 2A shows a top plan view of the apparatus of FIG. 1A;

FIG. 3A shows an alternative embodiment of a means of securing corresponding to the apparatus of FIG. 1A;

FIG. 3B shows an alternative embodiment of a means of securing capable of corresponding to the apparatus of FIG. 1A;

DESCRIPTION OF PREFERRED EMBODIMENTS

Figure 1:
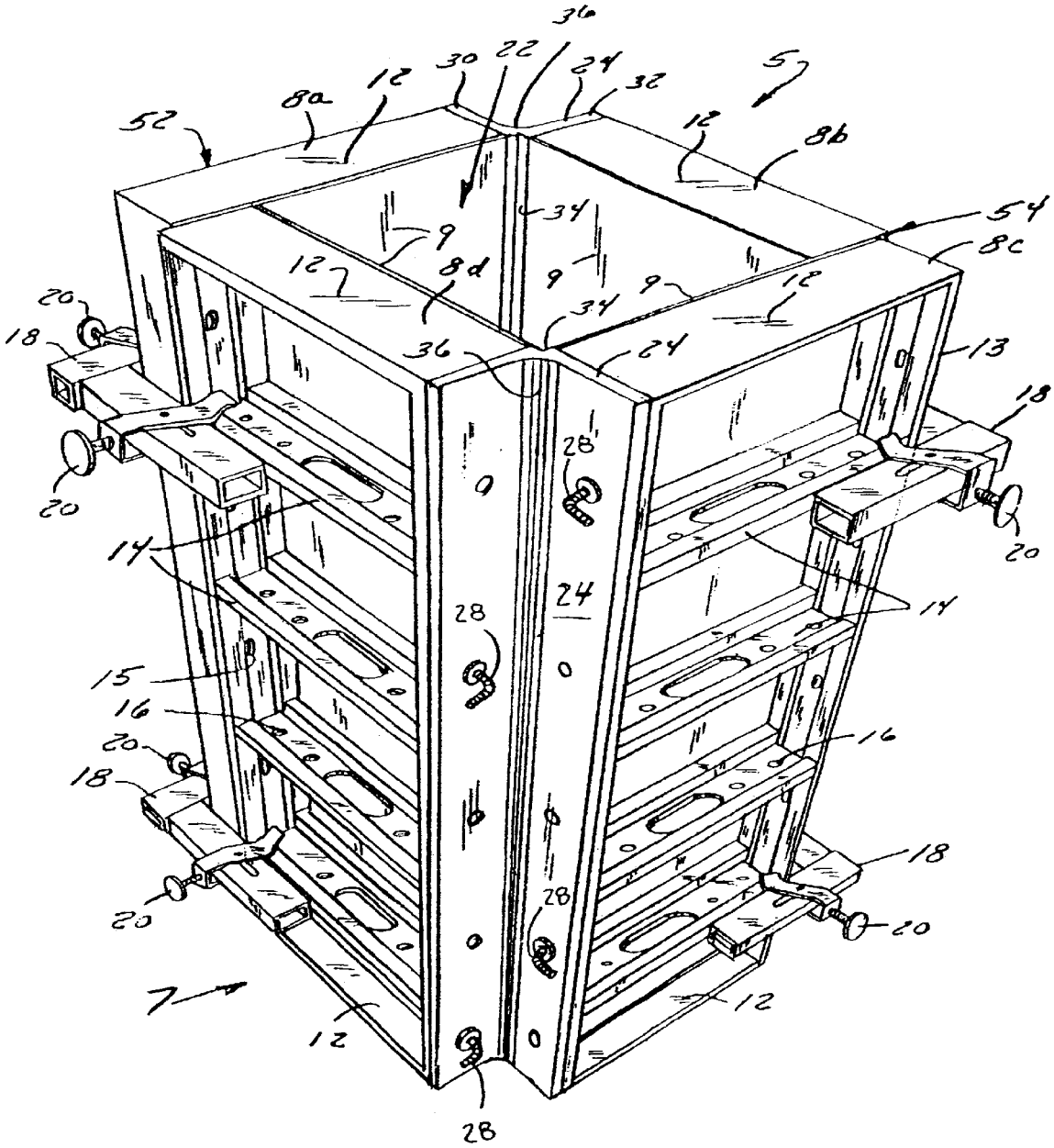
FIG. 1 shows a perspective view of one embodiment of the building structure forming apparatus of the current invention.

The present invention and the various features and advantageous details thereof are explained more fully with reference to the non-limiting embodiments described in detail in the following description.

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the examples should not be construed as limiting the scope of the present invention.

Referring to the drawings FIGS. 1–7, it can be seen that the present invention is a building structure forming apparatus 5. The structure forming apparatus is a form work mold which may be used to form columns and walls for construction projects. A typical building material contained by the form work is concrete, although other suitable building materials, such as polyurethane foam, can be used.

The apparatus 5 is formed generally from a plurality of panels 8 which may be constructed and arranged to form a column, a pilaster, a corner of wall, or some other building structure.

Referring to the embodiment shown in FIG. 1, the panels 8*a*, 8*b*, 8*c*, and 8*d* may be used to construct corner pairs or sets. In the embodiment shown, these corner sets may be configured to form a generally square, box-like structure for forming columns, pilasters, or the like. Alternatively, the corner sets may be constructed and arranged to form a wall corner (see FIG. 7).

Referring again to FIG. 1, the panels 8*a*, 8*b*, 8*c*, and 8*d* are preferably constructed of paneling 9 preferably constructed of plywood. Attached to the paneling 9 is a support structure comprised of outer horizontal support beams 12 and vertical support beams 13. In one preferred embodiment, inner horizontal support beams 14 are added for additional strength and support (best shown in FIG. 1). The vertical support beams 13 generally have a plurality of holes 15 throughout. Similarly, the horizontal support beams also have a plurality of holes 16.

As is known in the art, panels 8 can be joined together by outer corner clamps 18. The clamps 18 preferably can be adjusted and tightly secured by using securing mechanism 20. As shown in FIG. 1, a preferred mechanism 20 can be easily tightened by construction crew workers.

Figure 2:
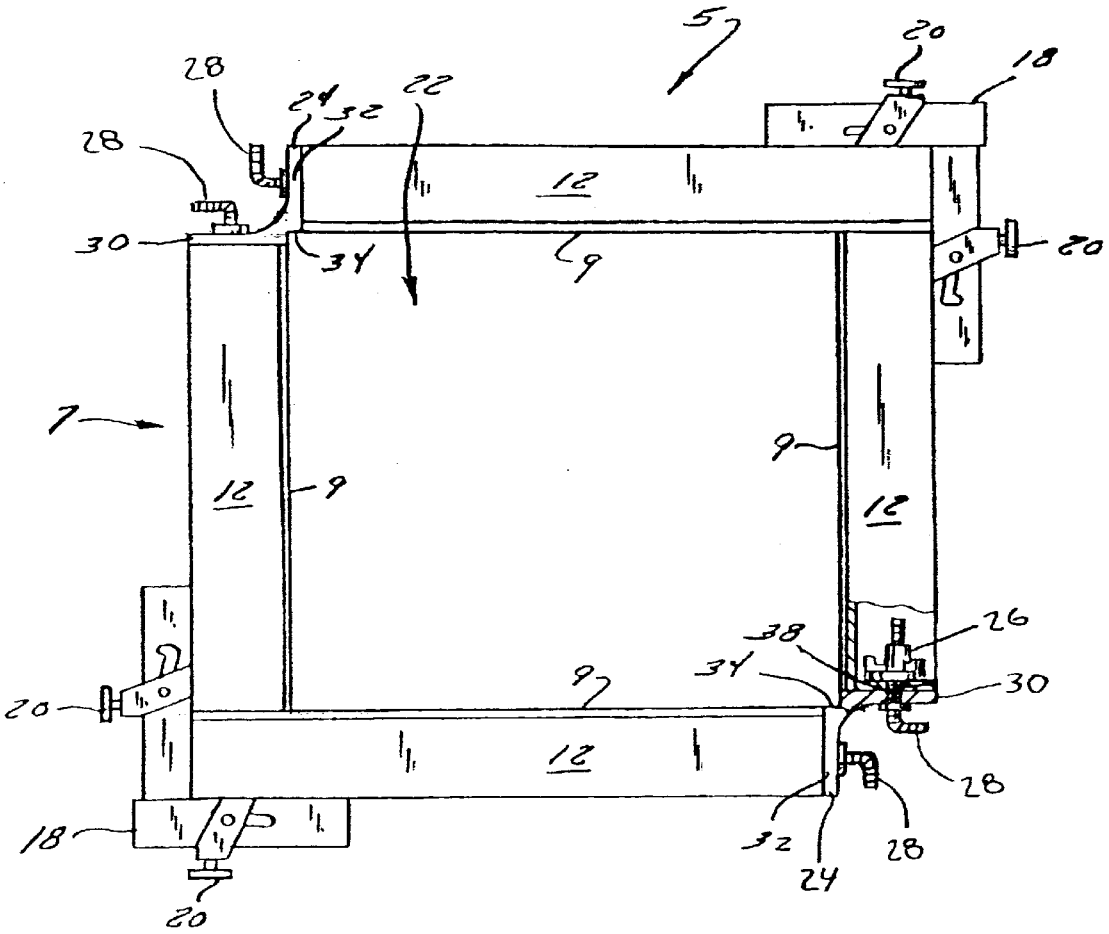
FIG. 2 shows a top plan view of the apparatus of FIG. 1.

Referring now to FIG. 2, once the clamps 18 are in place, a conversion corner bracket 24 connects the corner sets in the proper configuration to form a concrete column. Once the conversion corner brackets 24 are secured in place, they form a concrete receiving orifice 22. As shown by the partial cut-away sectional view of FIG. 2, as well as in FIG. 1, a securing member 28, such as a bolt, is generally inserted into a hole 15 in the vertical support beam 13 (both shown in FIG. 1) and secured on opposing sides by a nut 26.

Figure 3:
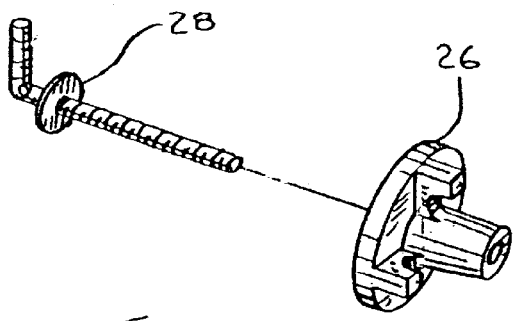
FIG. 3 shows one embodiment of a means of securing corners of the apparatus of FIG. 1.

FIG. 3 (as well as FIGS. 1 and 2 described above and FIGS. 6 and 7 which follow) illustrate one acceptable nut 26 and bolt 28 arrangement. As is illustrated, bolt 28 preferably comprises a bent handle portion. In one preferred embodiment, the handle portion is bent approximately 90° . The bend in the handle facilitates tightening of the nut and bolt arrangement by making it easier for one to grasp and hold. In addition the handle can act as a "stop" or "stopping" mechanism that can work to prevent the nut/bolt arrangement from loosening, and ultimately, becoming unfastened. It is understood that the number and placement of bolts (and their corresponding nuts) will vary to convenience, depending on the particular project requirements.

Figure 1A:
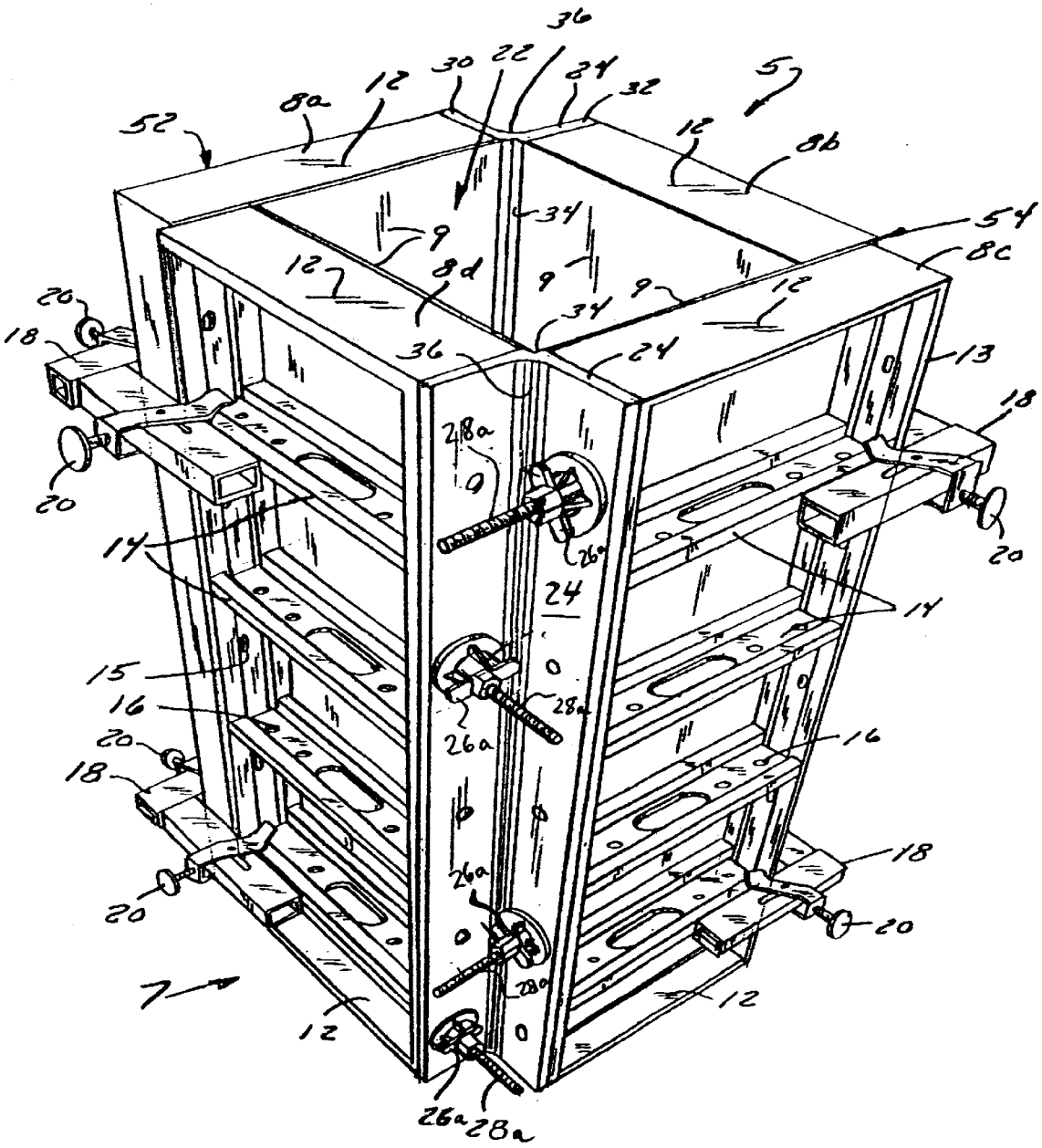
FIG. 1A shows a perspective view of another embodiment of the building structure forming apparatus of the current invention.

An alternative securing member embodiment comprising nut 26*a* and bolt 28*a* is illustrated in FIG. 3A. FIGS. 1A and 2A also illustrate this alternative securing member embodiment and are primarily included for this purpose. FIG. 3B illustrates yet another securing member embodiment, comprising nut 26*b* and bolt 28*b* which is similar to that of FIG. 3, but without the bent handle portion.

Figure 4:
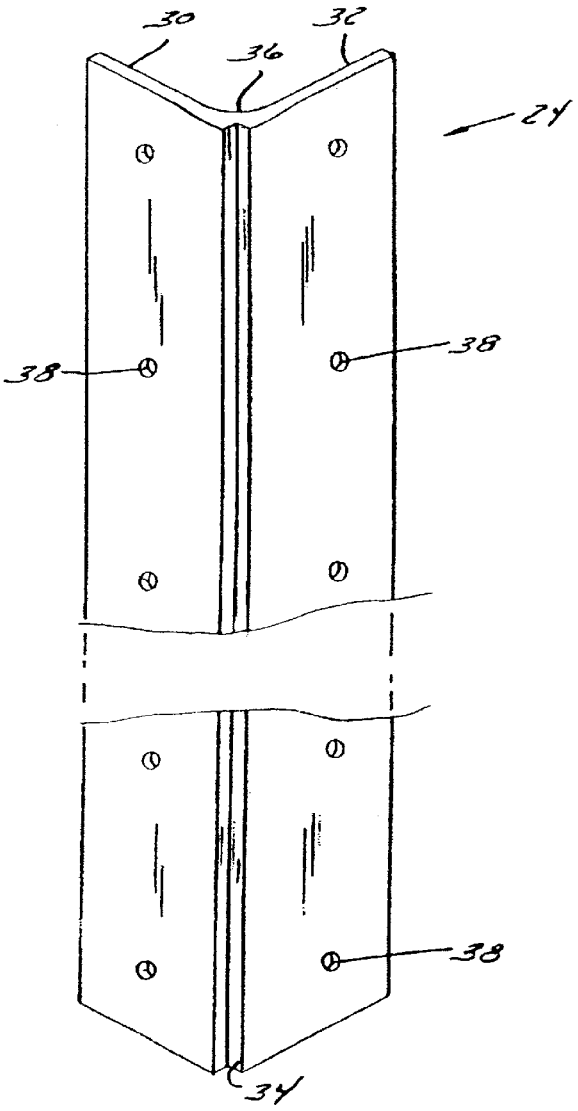
FIG. 4 shows a perspective view of one embodiment of the conversion corner bracket of the present invention.
Figure 5A:
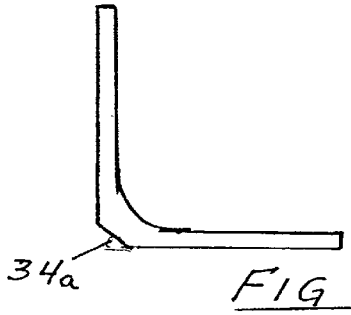
FIG. 5A shows an alternative top plan view of the conversion corner bracket of FIG. 5.
Figure 5:
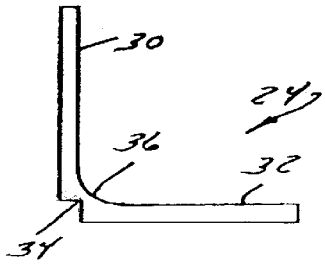
FIG. 5 shows a top plan view of the conversion corner bracket of FIG. 4.

Referring to FIGS. 4 and 5, the conversion corner bracket 24 has a bracket first leg 30 and a bracket second leg 32. In the preferred embodiment, the conversion corner bracket 24 is generally W-shaped to maximize strength while reducing weight. The legs 30, 32 are essentially joined to form a right angle. That is, a first plane of the first leg 30 and a second plane of the second leg 32 are perpendicular to each other, thus forming a 90° angle. An outer corner of the conversion corner bracket 24 is a V-shaped indented outer corner 34 which lies between the first leg 30 and the second leg 32. Opposite the V-shaped indented corner 34 is a rounded inside corner 36. Securing members or bolts secure the W-shaped conversion corner bracket 24 by penetrating bore 38 contained therein.

Alternatively, and as shown in FIG. 5A, the V-shaped indentation can be replaced with a substantially flat surface 34*a* at 45° to first leg 30 and second leg 32. This would provide a poured concrete column with a 45° chamfered corner.

Preferably, a plurality of similar bolts 28 secure each conversion corner bracket 24 through numerous bores 38 displaced along the length of the bracket 24, as best shown in FIG. 4. Once a bolt 28 is inserted into a bore 38, each bore 38 of the conversion corner 24 is then properly aligned with holes 15 in the vertical support beam 13. Nuts 26 are then preferably engaged with each bolt 28 to secure the conversion corner bracket 24 to the panels 8.

Figure 6:
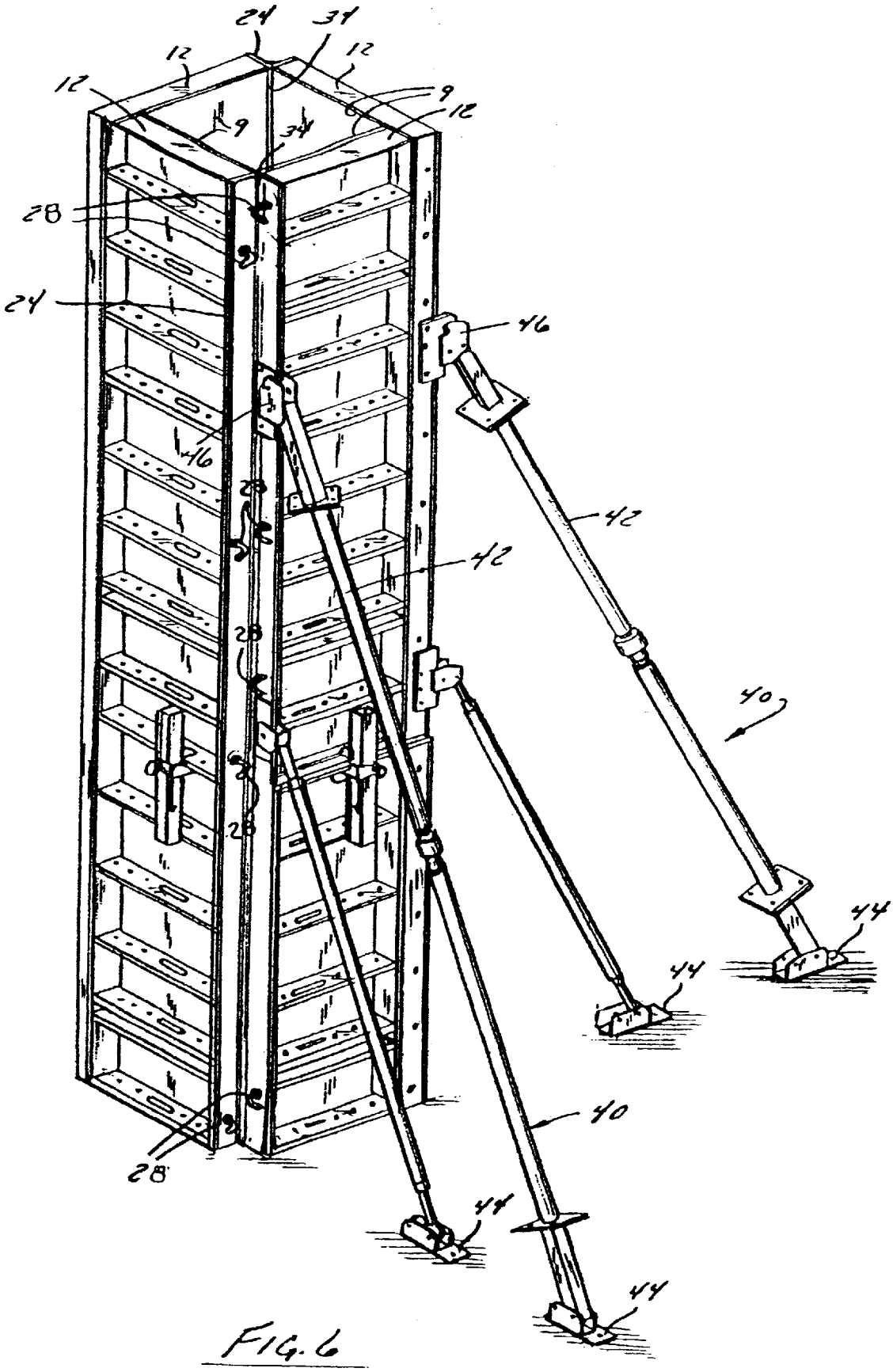
FIG. 6 shows one embodiment of a forming apparatus as typically used in the art.

Referring to FIG. 6, a typical form work column forming apparatus 5 is shown. In one preferred embodiment, the column forming apparatus 5 has a telescoping supporting tubular steel prop 40. The prop 40 is constructed of a tubular strut 42 which may consist of two or more telescoping tubes within a tube. Strut base 44 serves to stabilize the prop 40. A strut connector 46 connects the prop 40 to the vertical support beam 13 of a panel 8. Once erected, building material, such as concrete, is poured in between the first corner 52 and the second corner 54 of the form work to form building structure.

Figure 6A:
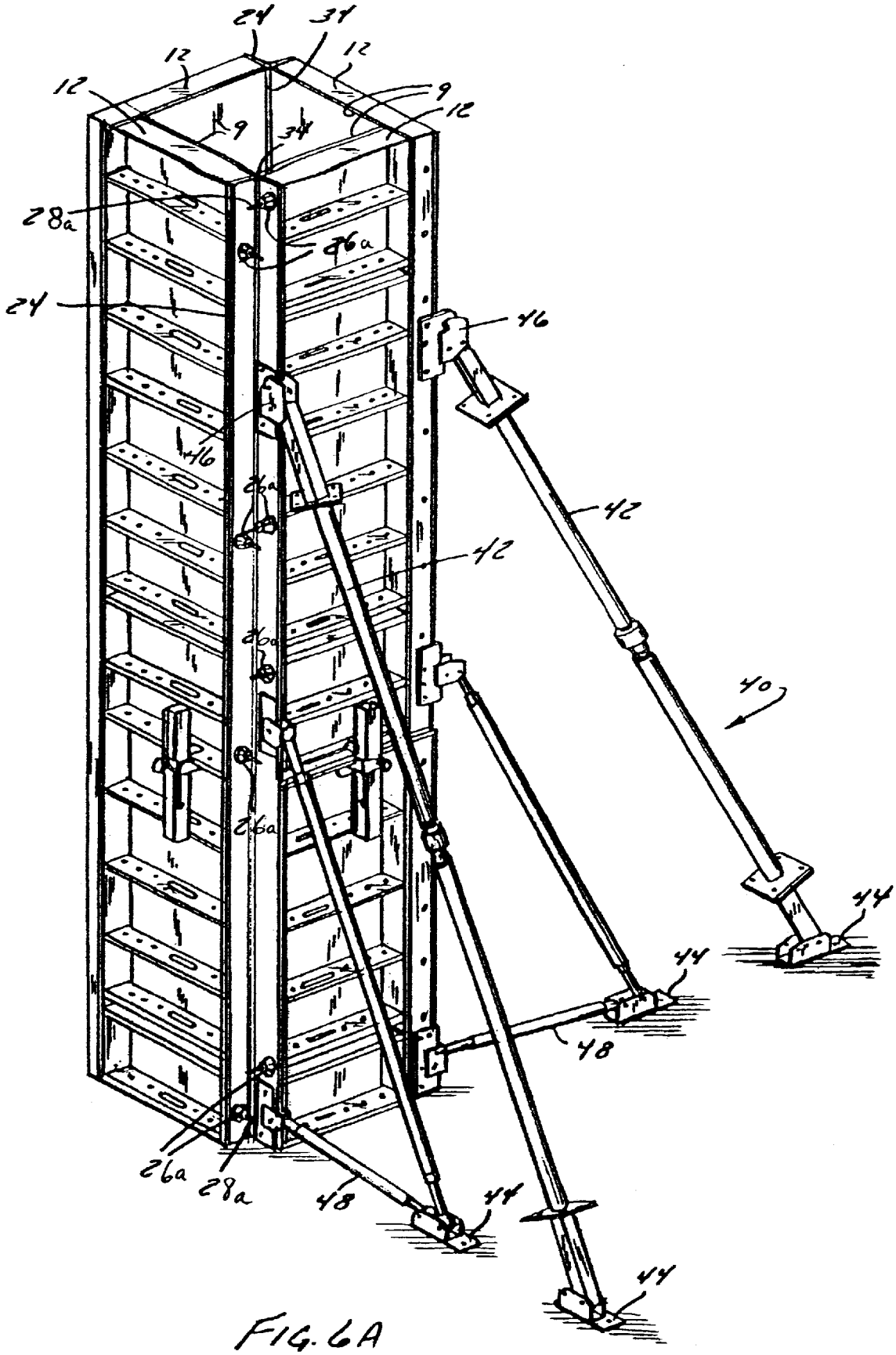
FIG. 6A shows another embodiment of a forming apparatus as typically used in the art.

As shown in FIG. 6A, a horizontal stabilizer bar 48 may be connected from the strut base 44 to the base of the form work 7 at a point near the bottom of a vertical support beam 13.

An important aspect of the inventive conversion corner bracket 24 is it can be properly dimensioned to allow for the use of standardized metric dimensioned panels to be used on U.S. customary unit based construction projects. Conversion corner bracket 24 can be constructed of extruded aluminum. The corner bracket typically will have a milled finish to ensure proper texture and dimensions.

In one preferred embodiment, the first leg 30 of conversion corner bracket 24 is about 5/16" wide and about 4¾" long. The V-shaped, indented outer corner 34 is approximately ⅜ deep along one dimension and ⅜" deep along the other. The second leg 32 is also about 5/16" thick and about 4¾" long. In one preferred embodiment, the extruded aluminum bracket 24 stands about 118.09" high. The bores 38 are approximately 0.75" in diameter. The radius of the rounded inside corner 36 is about 1¼". In another embodiment, the outside conversion corner bracket stands approximately 106.298" high. In another embodiment, the outside conversion corner stands approximately 5.045" high.

Table I (set forth below) shows the standardized U.S. customary unit-based column sizes which can be constructed from various metric unit based panels by using one preferred embodiment of the present invention.

TABLE I

| Column Size | Panel | Actual Dimension |
|---|---|---|
| 18 inches | 45 cm | 18.09 inches |
| 20 inches | 50 cm | 20.06 inches |
| 22 inches | 55 cm | 22.03 inches |
| 24 inches | 60 cm | 23.99 inches |
| 26 inches | 65 cm | 25.96 inches |
| 28 inches | 70 cm | 27.93 inches |
| 30 inches | 75 cm | 29.90 inches |
| 32 inches | 80 cm | 31.87 inches |
| 34 inches | 85 cm | 33.84 inches |
| 36 inches | 90 cm | 35.81 inches |
| For smaller columns the dimensions are: | | |
| 12 inches | 30 cm | 12.186 inches |

In the preferred embodiment illustrated above, the largest column which can be formed is 36 inches×32 inches. The smallest is (formed from 30 centimeters (cm) panels) is 18 inches×14 inches.

As can be expected, it is also possible to use a somewhat differently dimensioned conversion corner bracket 24 so that builders can use Imperial (also known as U.S. customary unit) unit based form work panels 8 to construct metric unit based building structures for metric unit based buildings. For example, a 60 centimeter column may be formed using a standardized 22-inch panel and 1⅝ inch conversion corner.

Figure 7:
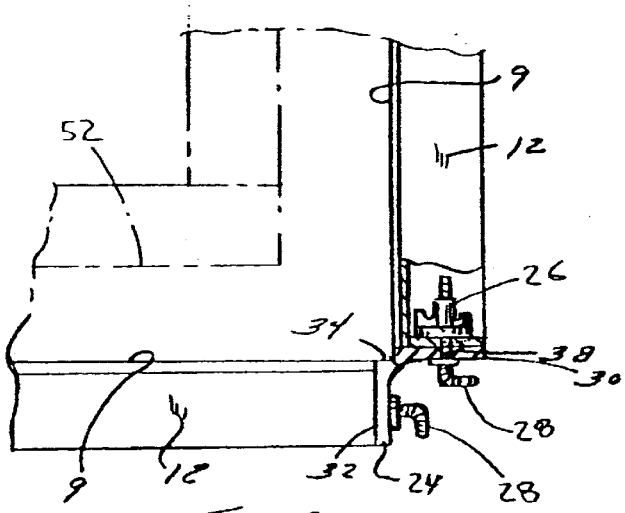
FIG. 7 shows an embodiment of a corner forming apparatus comprising a means for securing.

FIG. 7 shows an embodiment of a corner forming apparatus. The apparatus comprises means for securing such as bolt 28 and nut 26.

When in use and operation in one preferred embodiment, the following steps are followed: Two form work panels 8*a* and 8*b* are connected with a first conversion corner bracket 24 to form a first corner pair or set 52. Two additional form work panels 8*c* and 8*d* are connected to each other with a second conversion corner bracket 24 which is similar to the first conversion corner bracket to form a second corner pair or set 54.

The second corner set 54 is then properly configured to oppose the first corner set 52 to correctly form the intended structure. For example, if a corner of a wall is to be formed, the first corner 52 and the second corner 54 configured to resemble two offset L-shapes. On the other hand, if a column is to be formed, the first corner set 52 and the second corner set 54 are configured in a box shape (see FIG. 1). Once properly configured, the panels 8*a*, 8*b*, 8*c*, 8*d*are secured in place with a securing mechanism such as a clamp 20.

The form work panels 8*a*, 8*b*, 8*c*, and 8*d* are ten erected and supported if necessary by tubular steel props 40. Building material, such as concrete, is then poured between the first corner set 52 and the second corner set 54 to form a structure.

Conveniently, although aluminum is preferred, the conversion corner bracket of the present invention can be made of any material. Nevertheless, for the manufacturing operation, it is moreover an advantage to employ an extrudable, aluminum-like material. Similarly, the panels may be made of any suitable, durable, strong and lightweight material.

Moreover, the individual components need not be formed in the disclosed shapes, or assembled in the disclosed configuration, but could be provided in virtually any shape, and assembled in virtually any configuration. Further, although the panel components and conversion corner are described herein is physically separate modules, it will be manifest that they may be integrated. Furthermore, all the disclosed features of each disclosed embodiment can be combined with, or substituted for, the disclosed features of every other disclosed embodiment except where such features are mutually exclusive.

There may be virtually innumerable uses for the present invention, all of which need not be detailed here. Moreover, all the disclosed embodiments can be practiced without undue experimentation.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

The terms upper lower, top, bottom and the like in the specification and claims are intended to assist the reader in understanding invention and are not intended as terms of limitation.

It is intended that the appended claims cover all such additions, modifications and rearrangements. Expedient embodiments of the present invention are differentiated by the appended subclaims.

What is claimed is:

1. A building member forming apparatus comprising:

dimensioned form work panels; and an outside conversion corner bracket, the conversion corner bracket including:

a bracket first leg portion having an outer surface having a plane corresponding therewith;

a bracket second leg portion having an outer surface having a plane corresponding therewith, the outer surface of the bracket second leg portion positioned at about a 90 degree angle with respect to the outer surface of the bracket first leg portion;

a bracket flat-surfaced portion having a substantially flat outer surface, the flat outer surface disposed adjacent the outer surface of the bracket first leg portion and the outer surface of the bracket second leg portion such that the flat outer surface forms an approximately 45 degree angle with respect to the plane corresponding to the outer surface of the bracket first leg portion and an approximately 45 degree angle with respect to the plane corresponding to the outer surface of the bracket second leg portion; and a bracket rounded-surfaced portion that is located opposite the bracket flat-surfaced portion;

wherein the conversion corner bracket can be used in a building member forming apparatus to convert the dimensioned form work panels from one of metric dimensions to U.S. customary unit dimensions and to convert U.S. customary unit dimensions to metric unit dimensions.

* * * * *